United States Patent [19]

Niimi et al.

[11] 4,080,205

[45] Mar. 21, 1978

[54] SINTERED ALLOY HAVING WEAR-RESISTANCE AT HIGH TEMPERATURE

[75] Inventors: Itaru Niimi, Nagoya; Kametaro Hashimoto; Kenji Ushitani; Youichi Serino; Tetsuya Suganuma, all of Toyota; Seishu Mitani, Kyoto; Kunizo Imanishi, Nagoya, all of Japan

[73] Assignee: Toyota Jidosha Kogyo Kabushiki Kaisha, Toyota, Japan

[21] Appl. No.: 681,346

[22] Filed: Apr. 28, 1976

Related U.S. Application Data

[63] Continuation-in-part of Ser. No. 378,068, Jul. 11, 1973, abandoned.

[30] Foreign Application Priority Data

Jul. 13, 1972 Japan ..... 47-070235

[51] Int. Cl.[2] ..... B22F 3/00

[52] U.S. Cl. ..... 75/241; 75/246; 75/123 J; 75/123 K; 75/126 C; 75/128 W

[58] Field of Search ..... 75/123 J, 123 K, 126 C, 75/127; 29/187, 187.7

[56] References Cited

U.S. PATENT DOCUMENTS

| | | | |
|---|---|---|---|
| 2,183,715 | 12/1939 | Franks | 75/126 |
| 2,823,992 | 2/1958 | Bolkeom et al. | 75/123 |
| 3,698,055 | 10/1977 | Holtz et al. | 29/182.5 |
| 3,793,691 | 2/1974 | Takahashi et al. | 75/200 |
| 3,795,961 | 3/1974 | Takahashi et al. | 29/187 |
| 3,837,816 | 9/1974 | Takahashi et al. | 29/182 |

*Primary Examiner*—Brooks H. Hunt
*Attorney, Agent, or Firm*—Brisebois & Kruger

[57] ABSTRACT

A sintered alloy having improved wear resistance at high temperatures, comprising a soft, predominantly iron matrix having a Vickers hardness of 100–200 containing more than 5 but at most 20% Mo, together with 0.5–1.5% carbon and at least one additive selected from the group consisting of nickel, cobalt and chromium, with said additive constituting at most 25% by weight of said alloy, and most of said molybdenum being contained in Mo-Fe particles having a Vickers hardness of 600–1300 which are uniformly distributed within said matrix and have an average diameter of 20–70 microns.

8 Claims, 2 Drawing Figures

SINTERED ALLOY HAVING WEAR-RESISTANCE AT HIGH TEMPERATURE

BACKGROUND OF THE INVENTION

This application is a continuation-in-part of application Ser. No. 378,068, filed July 11, 1973 now abandoned.

Conventionally, valve seats are preferably made of special cast iron or heat-resisting steel. These valve seats function well in the case of gasolines containing anti-knocking agents such as tetraethyl lead, but are not satisfactory when the gasoline does not contain a lead component. The reason is that a variety of organic leads added to the gasoline are oxidized during combustion and adhere to the surface of the valve seats, serving to protect and lubricate the valve seat surfaces and to absorb the impact energy of the valve members, thereby eliminating abrasion of the valve seats. However, these effects of lead do not occur in the case of non-leaded gasoline, so that valve seats made of existing materials are significantly abraded, causing poor contact between the valve member and its valve seat and a resultant reduction in the output of the internal combustion engine. Consequently, normal operation can not be maintained.

SUMMARY OF THE INVENTION

The present invention relates to a sintered alloy having wear resistance at the high temperatures to which said seats are subjected in internal combustion engines.

DETAILED DESCRIPTION OF THE INVENTION

Figure 1:
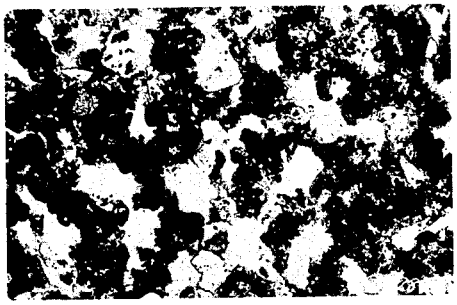
FIG. 1 is a microscopic photograph of an exemplary embodiment of a sintered alloy having good wear resistance at high temperatures according to the present invention. The photograph has been taken of the alloy at a magnitude of X100 and accordingly, "1 cm" in said photograph corresponds to "100$\mu$.
Figure 2:
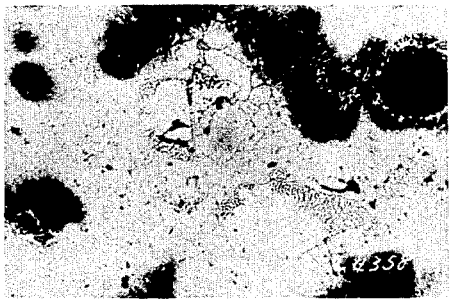
FIG. 2 is a similar photograph taken at a magnification of X400, with an arrow pointing to one of the Fe-Mo particles.

A sintered alloy according to this invention is an iron-base alloy comprising Fe as its main constituent, more than 5 but not more than 20% molybdenum (Mo) and 0.5–1.5% carbon, by weight, and characterized in that Fe-Mo phases having a Vickers hardness of 600–1300 are scattered in particles having an average diameter of 20–70 microns within a comparatively soft iron matrix having a Vickers hardness of 100–200, as shown best in FIG. 2.

Moreover, the sintered alloy according to this invention can remarkably be improved in heat-resistance by adding at least one additive selected from the group consisting of 1–15% Ni, 3–25% Cr, or 5–25% Co, with the total amount of additive constituting less than 25% of the total weight of the alloy. Its wear-resistance may also be improved due to an increase in high temperature hardness over that of an alloy containing no such additives depending on application conditions.

The functional effects of and limitations on each constituent of the sintered alloys according to this invention are described below. In the sintered alloy according to the present invention, carbon (C) exists in solid solution in Fe and forms pearlite, thereby effectively improving the alloy in hardness, wear-resistance and mechanical strength and may also improve wear-resistance by precipitating as molybdenum-dicarbide and -monocarbide. In a conventional Fe-Mo-C system, however, since less than 0.5% by weight of carbon does not achieve the above effect, a carbon content of more than 0.5% is desirable. However, if the carbon totals more than 1.5%, the above carbides and cementite precipitate excessively, significantly deteriorating the cuttability of the steel and producing undesirable liquid layers in the sintered alloy.

In this invention, the molybdenum (Mo) is characterized by the fact that the Mo is not dispersed uniformly in the Fe matrix but is scattered in particles from 20 to 70 microns in diameter, which particles have been formed into a (Mo $+\epsilon$) structure by controlling the dispersion of Mo into Fe to obtain a Vickers hardness of 600–1300, wherein $\epsilon$ denotes intermetallic compounds corresponding to the sintered structure $Mo_6Fe_7$. With such a (Mo $+\epsilon$) phase, the hardness is not reduced even at high temperature and a superb wear-resistance is achieved. The Mo $+\epsilon$ particles should contain 20–60% Fe. However, a molybdenum content as low as 5% of the total alloy does not provide sufficient wear-resistance and accordingly, a content of more than 5% is desirable.

Since a molybdenum content greater than 20% does not contribute to an increase in wear-resistance and leads to a lower mechanical strength of the alloy, the molybdenum content should be over 5 but not more than 20%. Some molybdenum exists in solid solution in Fe and is helpful in increasing tempering-softening resistance at high temperature, for improving shock-resistance, and at the same time, precipitated molybdenum forms oxides at high temperature thereby reducing the coefficient of friction and contributing to wear-resistance. Molybdenum (Mo) in either Mo powder or Fe-Mo alloy powder form is acceptable.

Ni forms a solid solution at any quantity in Fe, and improves alloys in toughness, and when the amount of the addition is large, improves heat-resistance as well as hardness. Moreover, in the alloy according to this invention, Ni also disperses into Fe and Mo to strongly bond Fe-Mo particles to the Fe matrix, and thereby serves to further improve the sintered alloy according to this invention in wear-resistance. As to the amount of nickel, when considering only wear-resistance, less than 1% has no effect, but anything more than 5% produces substantially the maximum effect. In order to improve both wear and heat-resistance, an amount up to 15% can be added depending upon the desired heat-resistance, but the addition of more than 15% does not provide any substantial further improvement in these properties. Therefore, such addition should be restricted to less than 15%.

Co is very similar in its effects to Ni, and has an effect nearly identical to that of Ni in the case of the present invention. Co is slightly inferior to Ni in the improvement of wear-resistance but superior in the improvement of heat-resistance and consequently, cobalt additions amounting to less than 5% do not have a useful effect. Accordingly, an amount of more than 5% is desirable. However, since an addition greater than 25% has only a slight effect, cobalt should be added within the range of from 5 to 25%.

Cr makes the Fe-matrix tough by existing in solid solution in the Fe-matrix and helps to improve alloys in hardness and wear-resistance by co-existing with $Fe_3C$ and forming composite carbides $(Fe_3C)_{18}Cr_4C$, $(Fe_3C)_9Cr_4C$ and $Fe_3CCr$. Also since Cr is stable at high temperatures, material deterioration due to high temperature is reduced and even more, heat-resistance is increased. The addition of less than 3% chromium has only a slight effect. Therefore, the addition of more than 3% is desirable. However, the addition of more than 25% does not produce an improvement sufficient to justify the cost and, what is worse, fragility occurs. Therefore, the addition of less than 25% chromium is desirable.

The alloy according to this invention is a sintered alloy having good wear-resistance at high temperature, characterized in that Mo—$\epsilon$ (molybdenum-epsilon) phases which are stable even at high temperature and have a Vickers hardness of 600–1300 are scattered in particles averaging from 20 to 70 microns in diameter within a comparatively soft Fe-matrix, having a Vickers hardness of 100–200. The wear-resistance as well as the high temperature-resistance can be further improved by strengthening the Fe-matrix and the bond between the Mo-$\epsilon$ phases and the Fe-matrix through addition of at least one of Ni, Co and Cr within the limits set forth above.

As described above, the sintered alloy according to this invention is remarkably superior in wear-resistance and accordingly, most suitable for use as a bearing material for an engine valve seat in an internal combustion engine in which fuels such as non-leaded gasoline, LPG (liquid petroleum gas), or light oil not containing a lubricating agent are burned.

Referring to certain specific embodiments, the invention will be explained as follows.

The attached Table shows comparisons of compositions, properties and wear-losses between eight types of alloys according to the present invention and a cast iron and two heat-resistant steels of conventional types. Wear-losses in the Table, which are represented by mm, indicate losses in the longitudinal direction of the specimens after testing for 100 hours by means of a high cycle sliding impact testing device which produces impacts at 30 Kg/cm$^2$ surface pressure 2500 times per minute against specimens held in a jig made of heat-resisting steel by rotating angular specimens mounted in the cast iron at 10 rpm at a temperature of 500° C–500° C.

molybdenum powders having a particle size of under 70$\mu$ and flaky graphite powders (carbon source) having a particle size of about 3$\mu$ were weighed to the specified ratio. The amount of graphite to be added was the end carbon amount + 0.1% graphite. Said composition, added with 0.5% by weight of zinc-stearate, as lubricant, was mixed for 30 minutes in a V-type mixer equipped with wings.

The resulting powders were formed into a mass having a density of 6.5 g/cm$^3$ in a mould by means of a hydraulic press.

The formed mass was sintered at 1150° C for 60 minutes in an atmosphere of cracked-ammonia gas. It will be appreciated that an acceptable product can be obtained if sintering is carried out a a few degrees more or less than 1150° C, for a few minutes more or less than 60.

The alloys of embodiments 3–8 were produced by mixing the above powders before molding with carbonyl nickel powders having a diameter of several $\mu$, cobalt powders having an average particle size of 2$\mu$ or ferro-chromium powders having a particle size of under 140$\mu$ in the specified composition, shaping them at a density of 6.5 g/cm$^3$, and then sintering them at about 1200° C for about 90 minutes in an atmosphere of cracked-ammonia gas.

The sintered product is then in either case, cooled at more than 12° C per minute to prevent dispersion of the Mo from the particles into the adjacent grains of the Fe matrix.

Alloys obtained by the processes described above according to the present invention, are outstanding in wear-resistance as compared with conventional alloys as indicated in the Table, and are improved in high temperature strength as expressed in tensile-strength at 600° C by adding Ni, Co or C as necessary.

What is claimed is:

1. A sintered alloy having improved wear resistance at high temperatures, comprising a soft, predominantly iron matrix having a Vickers hardness of 100–200 containing more than 5% but at most 20%, Mo, together with 0.5–1.5% carbon, most of said molybdenum being contained in Mo-Fe particles having a Vickers hardness of 600–1300 which are uniformly distributed within said matrix and have an average diameter of 20–70 microns.

2. A sintered alloy having improved wear resistance

TABLE

| Item Specimen | Alloy Composition (% by weight) | Hv (10kg) | Vickers Hardness (room temperature) Matrix m Hv(200) | Particle m Hv(200) | Vickers Hardness (600° C) Hv (5kg) | Tensile Strength (600° C) kg/mm | Wear-losses mm |
|---|---|---|---|---|---|---|---|
| Example No. 1 | Fe-8Mo-0.8C | 155 | 130 | 1080 | 115 | 19 | 3.11 |
| Example No. 2 | Fe-18Mo-1.2C | 220 | 180 | 1250 | 160 | 24 | 0.72 |
| Example No. 3 | Fe-8Mo-2Ni-0.8C | 215 | 185 | 1030 | 170 | 33 | 0.45 |
| Example No. 4 | Fe-8Mo-10Co-0.8C | 185 | 150 | 1100 | 155 | 35 | 2.33 |
| Example No. 5 | Fe-8Mo-5Cr-0.8C | 260 | 200 | 1030 | 230 | 43 | 0.92 |
| Example No. 6 | Fe-10Mo-5Cr-12Ni-0.8C | 240 | 190 | 1150 | 205 | 47 | 0.35 |
| Example No. 7 | Fe-5Mo-3Cr-2Ni-10Co-0.5C | 180 | 170 | 980 | 155 | 36 | 2.54 |
| Example No. 8 | Fe-12Mo-2Ni-10Co-0.5C | 235 | 200 | 1200 | 195 | 39 | 0.42 |
| Control Example No. 1 (Cast iron) | Fe-3.5C-2.5Si-1MnO-0.5P -0.5Cr-0.5Mo-0.1V | 280 | | | 220 | 30 | 7.42 |
| Control Example No. 2 (Heat-resisting steel) | Fe-0.4C-2Si-15Cr-15Ni -2W-0.5Mn | 300 | | | 260 | 45 | 6.88 |

The alloys for embodiments 1 and 2 were produced as follows.

As starting material powders, millscale-reduced iron powders having a particle size of under 140$\mu$, reduced at high temperatures, comprising a soft, predominantly iron matrix having a Vickers hardness of 100–200 containing more than 5% but at most 20% Mo, together with 0.5–1.5% carbon, and at least one additive selected from the group consisting of nickel, cobalt and chromium, with said additive constituting at most 25% by weight of said alloy, and most of said molybdenum being contained in Mo-Fe particles having a Vickers hardness of 600–1300 which are uniformly distributed within said matrix and have an average diameter of 20–70 microns.

3. Alloy as claimed in claim 1 which has been sintered at about 1150° C for about 1 hour, and then cooled to 600° C at the rate of at least 12° C per minute.

4. Alloy as claimed in claim 2 which has been sintered at about 1200° C for about 90 minutes, and then cooled to 600° C at the rate of at least 12° C per minute.

5. Alloy as claimed in claim 1 in which said particles contain 20–60% iron.

6. A sintered alloy as claimed in claim 2 comprising 1–15% Ni and 5–24% Co, but less than 25% of both.

7. A sintered alloy as claimed in claim 2 comprising 1–12% Ni and 3–24% Cr by weight, but less than 25% of both.

8. A sintered alloy as claimed in claim 2 comprising 1–15% Ni, 5–21% Co and 3–19% Cr but less than 25% of all three.

* * * * *